US008449417B2

(12) United States Patent
Bevier et al.

(10) Patent No.: US 8,449,417 B2
(45) Date of Patent: May 28, 2013

(54) FOOTBALL INCLUDING INDICIA TO IMPROVE VISIBILITY

(75) Inventors: Joseph J. Bevier, Portland, OR (US); Damon M. Cellan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 436 days.

(21) Appl. No.: 12/208,405

(22) Filed: Sep. 11, 2008

(65) Prior Publication Data

US 2010/0062883 A1 Mar. 11, 2010

(51) Int. Cl.
*A63B 41/08* (2006.01)

(52) U.S. Cl.
USPC ..... 473/603; 40/327

(58) Field of Classification Search
USPC ..... 473/603, 599, 597, 609; 40/327; D21/712
See application file for complete search history.

(56) References Cited

U.S. PATENT DOCUMENTS

| | | | | | |
|---|---|---|---|---|---|
| 3,370,851 | A | * | 2/1968 | Murray | 40/327 |
| 3,425,693 | A | * | 2/1969 | Murray | 40/327 |
| 4,867,452 | A | * | 9/1989 | Finley | 40/327 |
| 5,354,053 | A | | 10/1994 | Ratner et al. | |
| D354,102 | S | * | 1/1995 | Lehman | D21/712 |
| D355,685 | S | * | 2/1995 | Ross | D21/712 |
| 5,427,372 | A | | 6/1995 | Ratner et al. | |
| 5,451,046 | A | | 9/1995 | Batton | |
| 5,470,058 | A | | 11/1995 | Sullivan et al. | |
| 5,676,611 | A | | 10/1997 | Foster et al. | |
| 5,741,195 | A | | 4/1998 | Sullivan et al. | |
| D400,668 | S | * | 11/1998 | Bloom | D23/379 |
| D452,892 | S | * | 1/2002 | Frisina et al. | D21/712 |
| D452,893 | S | * | 1/2002 | Frisina et al. | D21/712 |
| D452,977 | S | * | 1/2002 | Frisina et al. | D21/712 |
| D453,036 | S | * | 1/2002 | Frisina et al. | D21/712 |
| D453,037 | S | * | 1/2002 | Frisina et al. | D21/712 |
| D453,201 | S | * | 1/2002 | Frisina et al. | D21/712 |
| D453,202 | S | * | 1/2002 | Frisina et al. | D21/712 |
| 6,722,889 | B1 | * | 4/2004 | Page et al. | 473/438 |
| D497,655 | S | * | 10/2004 | Frisina | D21/712 |
| D503,760 | S | * | 4/2005 | Chang | D21/712 |
| D504,709 | S | * | 5/2005 | Chang | D21/712 |
| D518,536 | S | * | 4/2006 | Chang | D21/712 |
| 7,029,407 | B2 | | 4/2006 | Lee et al. | |
| D584,778 | S | * | 1/2009 | Bevier | D21/712 |
| 2004/0121865 | A1 | * | 6/2004 | Lee et al. | 473/597 |
| 2005/0113195 | A1 | | 5/2005 | Carbonero | |

(Continued)

FOREIGN PATENT DOCUMENTS

| | | | |
|---|---|---|---|
| AU | 143476 S | * | 4/2001 |
| EP | 000188560-0001 | * | 8/2004 |

(Continued)

OTHER PUBLICATIONS

Joseph, L. Nicole, "Health Alerts, Footballs" American Academy of Pediatrics, AAP News, vol. 24, No. 4 Apr. 2004, p. 194.

*Primary Examiner* — Steven Wong
(74) *Attorney, Agent, or Firm* — Plumsea Law Group, LLC

(57) ABSTRACT

A prolate spheriodal ball includes first and second ends and first and second mid regions between the first and second ends and the tranverse axis, respectively. The ball is colored with a first color. First and second tips at first and second ends are colored to contrast with the first color. First and second mid regions include colored regions that are colored to contrast with the first color. The peripheries of the contrasting colored regions are continuous around the ball.

24 Claims, 11 Drawing Sheets

U.S. PATENT DOCUMENTS

| | | | | |
|---|---|---|---|---|
| 2005/0245335 | A1 * | 11/2005 | Frisina | 473/597 |
| 2006/0160644 | A1 | 7/2006 | Hu et al. | |
| 2006/0211527 | A1 | 9/2006 | Guenther et al. | |

FOREIGN PATENT DOCUMENTS

| | | | |
|---|---|---|---|
| EP | 000724141-0002 | * | 6/2007 |
| GB | Des. 4000483 | * | 11/2006 |
| GB | Des. 3021478 | * | 6/2007 |
| JP | 06315546 A | * | 11/1994 |
| WO | DM/052235 | * | 2/2000 |

* cited by examiner

FOOTBALL INCLUDING INDICIA TO IMPROVE VISIBILITY

BACKGROUND OF THE INVENTION

1. Field of the Invention

The present embodiments relate to the field of American footballs and more specifically to the area of footballs that include features improving the visibility of the football and the ability of a receiver to catch the football.

2. Description of Related Art

Footballs have been in use for many years. Many footballs are formed of various pieces, usually four sections, of hide, plastic, or fabric stitched or otherwise secured to one another. These footballs are then inflated.

Most footballs include some sort of indicia placed thereon. For example, it is common to place a white stripe half way around a football on each side of a transverse axis. In other cases, a manufacturer may place its name, logo, or other identifying indicia that would assist a user in determining the source of the football. In addition, indicia relating to the characteristics of the football may be included. For example, a manufacturer may include indicia stating whether the football is of the regulation size under the rules of varying agencies, such as under NCAA or high school rules. Finally, other details, such as the appropriate inflation pressure, could be noted on the ball.

On most footballs, there is an area called the laces or lace element that assist a user in properly positioning his or her hands to throw the football. The lace element may provide additional grippability and can assist the user in determining the proper pressure to apply to create an appropriate spiral on the ball.

However, few footballs have been designed that include indicia that improve the visibility of the football and the ability of a receiver to catch a football. Indicia commonly used on footballs are discontinuous and can hinder a receiver's ability to properly see the ball. In addition, at many levels of competition, such as high school fields and fields for ages younger than high school age, the lighting conditions are inconsistent and may further impede a receiver's ability to see and catch the ball.

There is a need in the art for a system and method that addresses the shortcomings of the prior art discussed above. Accordingly, a football or other prolate spheroid ball that includes indicia that improve visibility and that can assist the receiver is desirable.

SUMMARY OF THE INVENTION

In an exemplary embodiment, a prolate spheroidal ball may include a body having first and second ends and transverse and longitudinal axes. The body may be made from a material having a first color. The body may have a first tip located at the first end and a second tip located at the second end. The tips may be colored with a second color that contrasts with the first color. A first mid region of the body may be between the first tip and the transverse axis. A second mid region of the body may extend between the second tip and the transverse axis. Each of the first and second mid regions may include a portion colored with the second color. Each of the mid region portions colored with the second color and the first and second tips may have an outer periphery that has a ring shape continuous around the body.

The first color may be a generally tan color and the second color may be a color that contrasts highly with the first color. The second color may have a dominant wavelength between about 520 and about 770 nm. The first color and the second color may be flat. The second color may cover less than about 50% of the surface area of the body.

The prolate spheroidal ball may further include a lace element. Each mid region portion that is colored with the second color may have an inner periphery that is ring shaped over at least half of a circumference of the body. A portion of the inner periphery may extend to form a finger portion adjacent the lace element.

In another exemplary embodiment, a prolate spheroidal ball may include a body having first and second ends and transverse and longitudinal axes. The body may be made from a material having a first color. The body may have a first tip located at the first end. The tip may be colored with a second color that contrasts with the first color. A first mid region of the body may be between the first tip and the transverse axis. The first mid region may include a portion colored with the second color. The mid region portion colored with the second color may have an outer periphery that has a ring shape continuous around the body.

The first color may be a generally tan color and the second color may be a color that contrasts highly with the first color. The second color may have a dominant wavelength between about 520 and about 770 nm. The first color and the second color may be flat.

The prolate spheroidal ball may further include a lace element. The mid region portion that is colored with the second color may have an inner periphery that is ring shaped over at least half of a circumference of the body. A portion of the inner periphery may extend to form a finger portion adjacent the lace element.

In another exemplary embodiment, a prolate spheroidal ball may include a body having first and second ends and transverse and longitudinal axes. The body may be made from a material having a first color. The body may have a first tip located at the first end. The tip may be colored with a second color that contrasts with the first color.

The first color may be a generally tan color and the second color may be a color that contrasts highly with the first color. The second color may have a dominant wavelength between about 520 and about 770 nm. The first and second colors color may be flat. The second color may cover no more than about 50% of the surface area of the body.

In another exemplary embodiment, a prolate spheroidal ball may include a body having a longitudal axis, a transverse axis, an external surface, and first and second ends. A first body portion may extend from the tranverse axis to the first end, and the first body portion shape may be conical in shape.

The first body portion may be divided into three sections, a first section extending from the first end and being conical in shape, a third section being generally frustoconical in shape and extending from the transverse axis, and a second section being generally frustoconical in shape and extending between the first section and the third section. The first section and the second section may have contrasting colors. The second section and at least one area of the third section may have contrasting colors.

In another exemplary embodiment, a prolate spheroidal ball may include a body having first and second ends and transverse and longitudinal axes. The body may be made from a material having a first color. The body may have a first tip located at the first end. The tip may be colored with a second color that contrasts with the first color. A first mid region of the body may be between the first tip and the transverse axis. The first mid region may include a portion colored with a third color. The mid region portion colored with the third color may have an outer periphery that has a ring shape continuous around the body.

The first color may be a generally tan color and the second and third colors may be colors that contrast highly with the first color. The second and third colors may have dominant wavelengths between about 520 and about 770 nm. The first, second, and third colors color may be flat.

The prolate spheroidal ball may further include a lace element. The mid region portion that is colored with the third color may have an inner periphery that is ring shaped over at least half of a circumference of the body. A portion of the inner periphery may extend to form a finger portion adjacent the lace element Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

The present invention relates to a prolate spheroidal ball, such as a football. The prolate spheriodal ball may be pointed, such as is typically used in American football. While the pointedness of a ball typically used to play American football, such as the balls approved for use in the NCAA and the NFL, causes it to differ from a true geometric prolate spheroid, such balls are typically considered to be prolate spheroidal balls, and are encompassed by that term as used herein.

The description of the football and visibility indicia may be easier to understand by viewing the football in regions due to its shape. One way of viewing the football is that of two halves that are generally cones or conical sections that have their flat ends in abutting relation. The football and indicia may are often placed generally symmetrically about the plane defined where the ends abut. This plane may also be defined as a transverse axis, as the axis could pass through the football anywhere along that plane of symmetry. Another axis that is present on the ball is a longitudinal axis that is defined by the points that are present at the tops of the cones. The ball is rotationally symmetrical about this axis. Looking at each conical section, the section can be divided into a stack or union of various frustoconical segments between two conical end pieces. These conical and frustoconical segments are defined most clearly when they are colored or otherwise marked with varying indicia so that the ball is more visible. The conical and frustoconical segments meet one another in ring-shaped boundaries.

Figure 1:
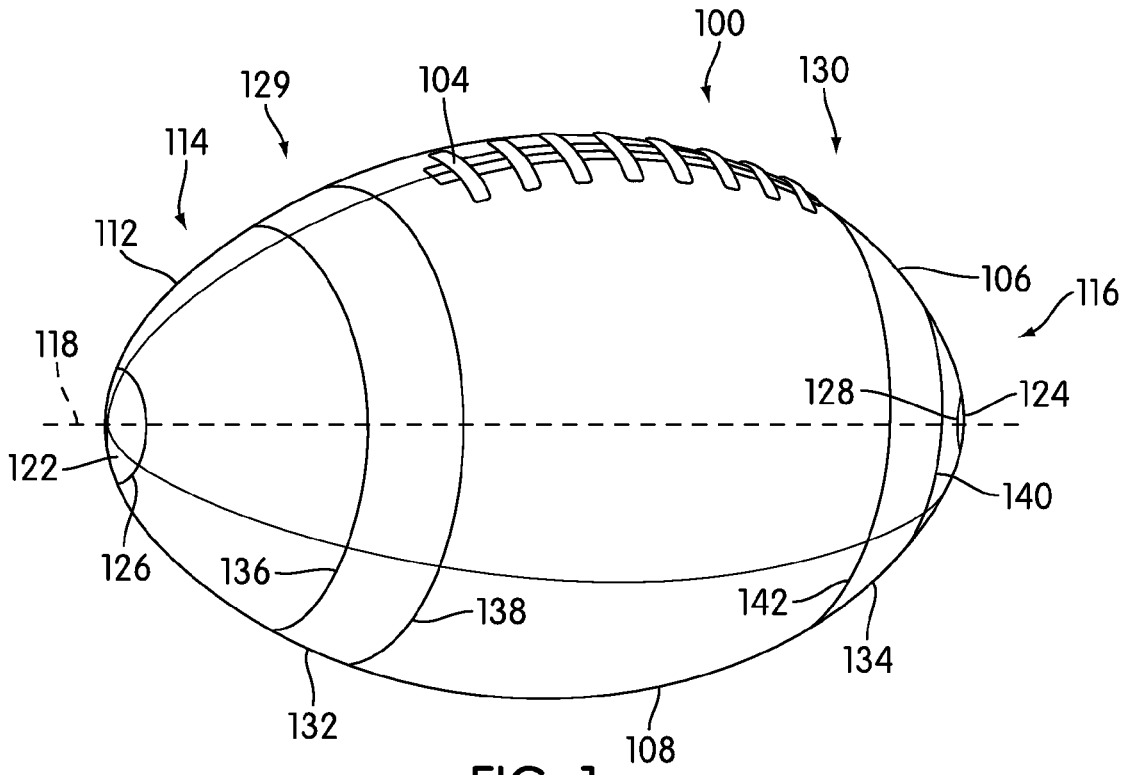
FIG. 1 is a perspective view of a first exemplary embodiment.
Figure 2:
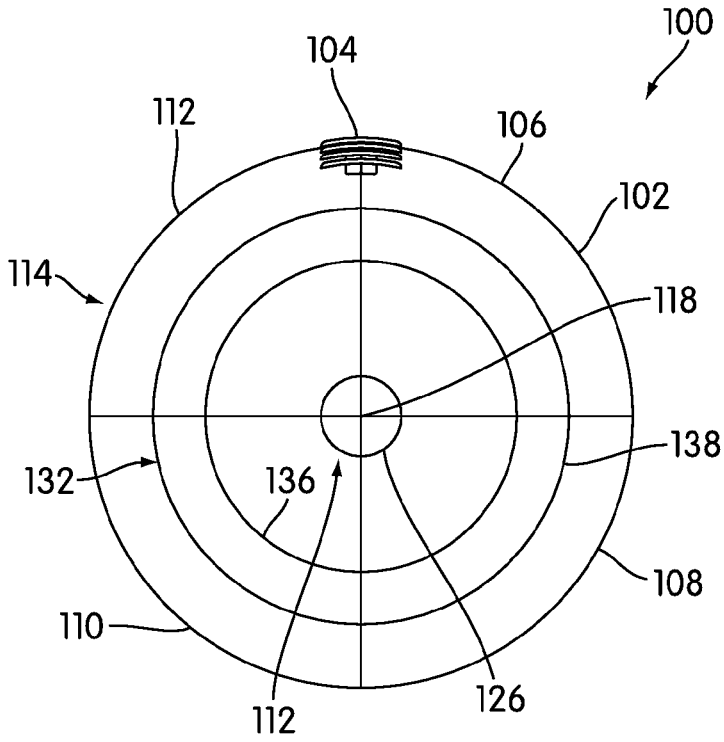
FIG. 2 is an end view of the first exemplary embodiment.
Figure 3:
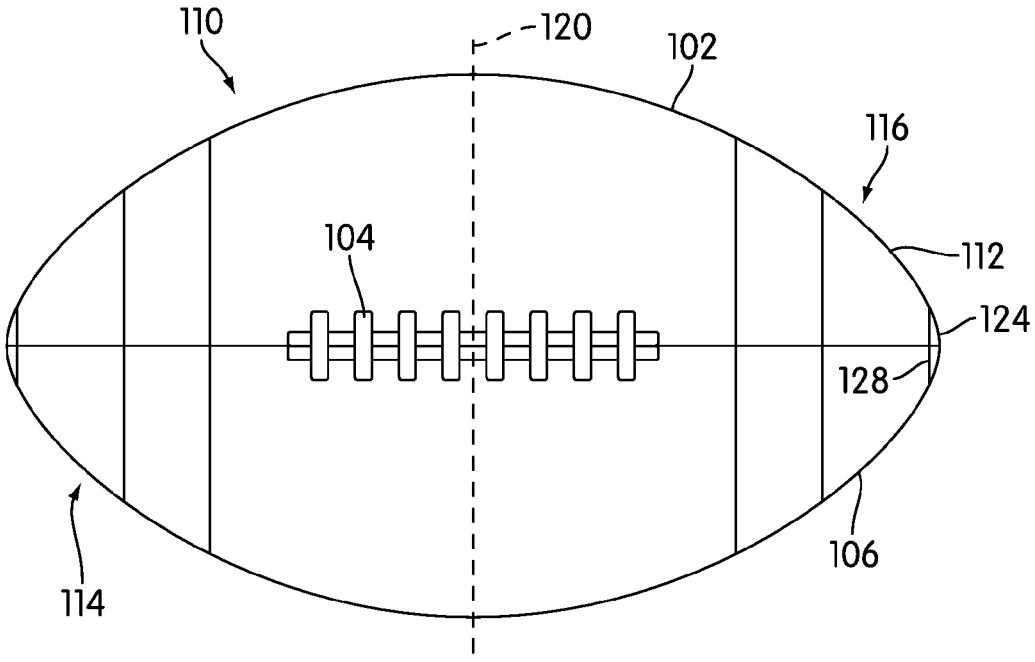
FIG. 3 is a top view of the first exemplary embodiment.

A first exemplary embodiment is shown in FIGS. 1-3. FIGS. 1-3 show a prolate spheroidal ball 100. The ball 100 includes a body 102 and a lace element 104. The body 102 may be made of one or more body segments 106, 108, 110, 112. As is shown in FIGS. 1-3, one embodiment of the body 102 may include four body segments 106, 108, 110, 112 that are sewn or otherwise secured together. A bladder (not shown) inside the body 102 is filled with air to a particular pressure level. A variety of pressure levels may be appropriate for any particular game. No specific structure is necessary to allow a user to fill the body 102 with air, but a conventional inflation valve (not shown) that permits the insertion of a typical needle (not shown) that may be connected to a bicycle pump or other suitable pump (not shown) may be included. This type of inflation valve may be positioned anywhere desirable on the body 102 as a designer might select.

The lace element 104 may be included as a functional member of the ball 100, for example to secure in part body segments 106, 112 to one another. Alternatively, the lace element 104 may be attached to perform a decorative function or may be included only to assist a user in correctly positioning his or her hand to pass or grip the ball 100. The lace element 104 may be attached to the body 102 in any suitable conventional manner, depending on the materials selected for the body 102 and the lace element 104. For example, the body 102 and the lace element 104 may both be made from leather and the lace element 104 may be inserted into perforations in the body 102. In such a case, it may be desirable to include reinforcements on the body 102 to prevent the lace element 104 from tearing through the body 102. In another example, the body 102 might be rubber and the lace element 104 might be polyvinyl chloride, rubber, silicone, or other thermoplastic elastomers. In such a case, an adhesive might be used to adhere the lace element 104 to the outside of the body 102.

The body 102 of the ball 100 includes a first end 114 and a second end 116. The body 102 also includes a longitudinal axis 118 and a transverse axis 120. The body 102 may have a single color, but may have various indicia imprinted thereon that may be of various colors. Even if indicia of varying colors are imprinted thereon, the body 102 is made from a material that has a first color.

At the first end 114 of the body 102 is a first tip 122. At the second end 116 of the body 102 is a second tip 124. Each of the first and second tips 122, 124 is colored with a second color that contrasts with the first color. The outer periphery 126 of the first tip 122 has a ring shape. The outer periphery 128 of the second tip 124 has a ring shape. Each ring shape is continuous around the circumference of the body 102 at its respective position along the body 102.

The body also includes a first mid region 129 between the first tip 122 and the transverse axis 120 and a second mid region 130 between the second tip 124 and the transverse axis 120. A portion 132 of the first mid region 129 is colored with the second color. A portion 134 of the second mid region 130 is colored with the second color. The portion 132 of the first mid region 129 that is colored with the second color includes an outer periphery 136 and an inner periphery 138. The outer periphery 136 and inner periphery 138 each have a ring shape. The portion 134 of the second mid region 130 that is colored with the second color has an outer periphery 140 and an inner periphery 142. In this exemplary embodiment, each of the outer peripheries 136, 140 are ring shaped and are continuous around the body 102.

It is desirable that the outer peripheries of the tips 126, 128 and the mid region portions colored with the second color 136, 140 be ring shaped and continuous around the body 102 in each periphery's longitudinal position along the longitudinal axis 118. When the peripheries 126, 128, 136, 140 are continuous, a receiver's eye is able to see the tip and mid portions easily without the flickering or blurring that is common when the tip and mid portions do not have a continuous boundary or periphery.

In this exemplary embodiment, the inner peripheries 138, 142 are also ring shaped and continuous around the body 102. In some applications, the use of such a design may be useful.

The first color may be a generally tan color, but may be any color that a designer feels is appropriate for the particular application. The second color should contrast with the first color and may be any color that contrasts highly with the first color. In one exemplary embodiment, the second color has a dominant wavelength between about 520 nm and about 770 nm. Both the first color and the second color may be flat, as colors having sheen or gloss may be less able to be seen in certain lighting conditions. The second color may cover no more than about 50% of the surface area of the body 102.

Figure 4:
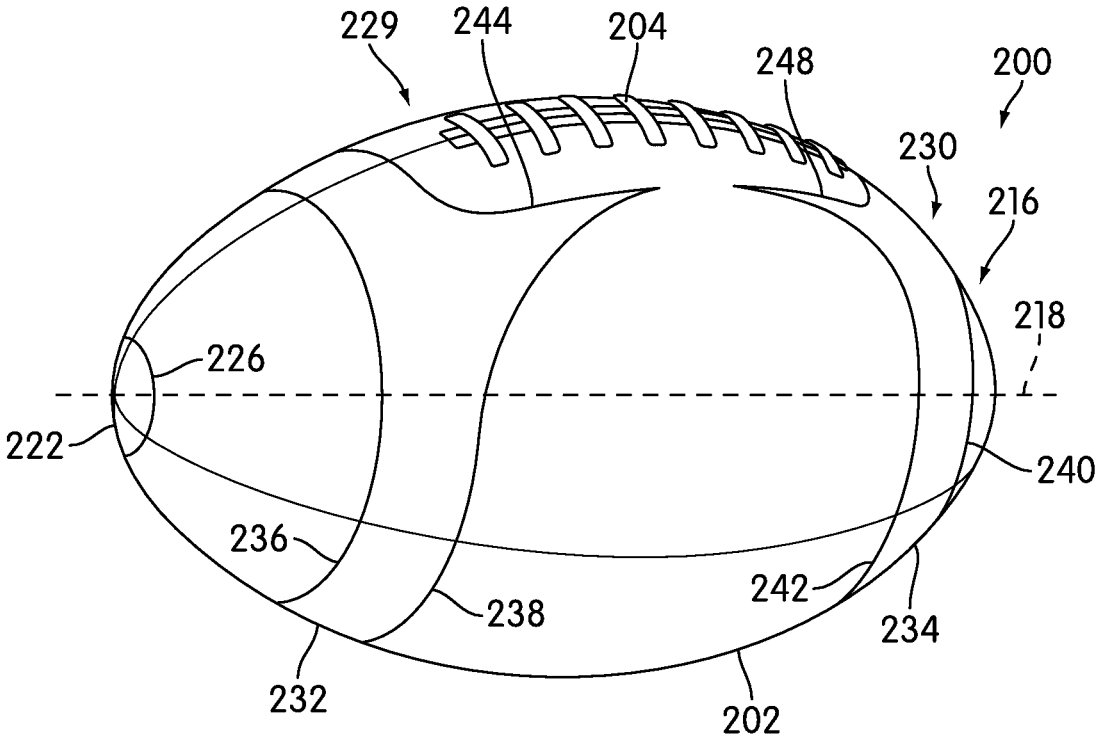
FIG. 4 is a perspective view of a second exemplary embodiment.
Figure 5:
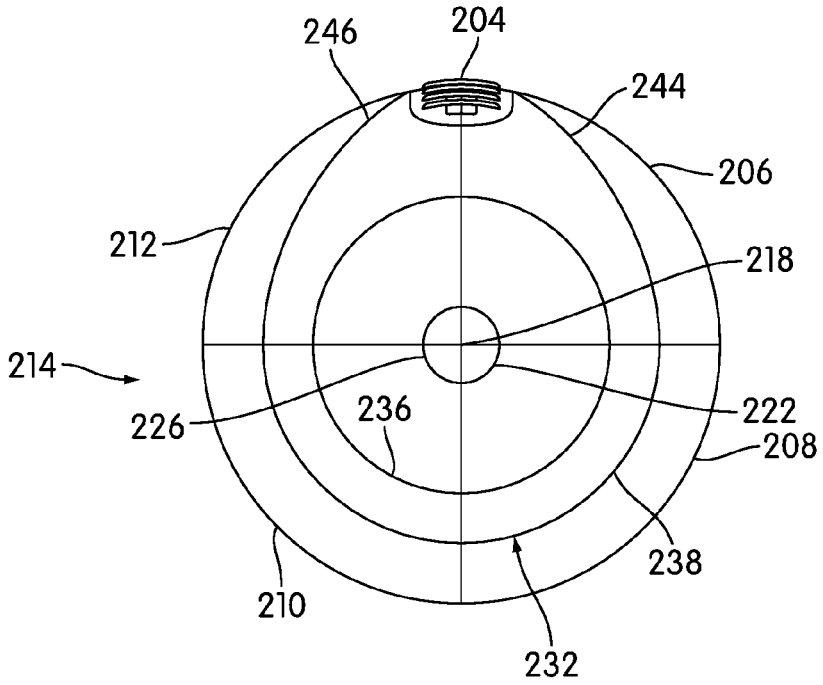
FIG. 5 is an end view of the second exemplary embodiment.
Figure 6:
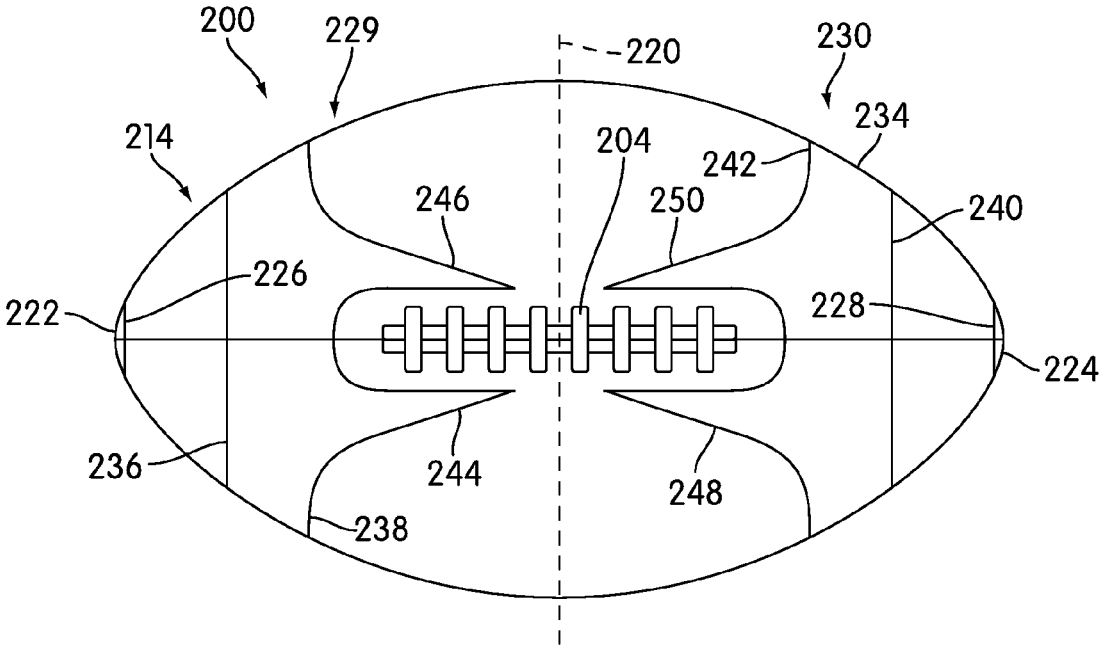
FIG. 6 is a top view of the second exemplary embodiment.

Another exemplary embodiment is shown in FIGS. 4-6. In this embodiment, FIGS. 4-6 show a prolate spheroidal ball 200. The ball 200 includes a body 202 and lace element 204. The body 202 may be made of one or more body segments 206, 208, 210, 212. As is shown in FIGS. 4-6, one embodiment of the body 202 may include four body segments 206, 208, 210, 212 that are sewn or otherwise secured together. A bladder (not shown) inside the body 202 is filled with air to a particular pressure level. A variety of pressure levels may be appropriate for any particular game. No specific structure is necessary to allow a user to fill the body 202 with air, but a conventional inflation valve (not shown) that permits the insertion of a typical needle (not shown) that may be connected to a bicycle pump or other suitable pump (not shown) may be included. Such an inflation valve may be positioned anywhere desirable on the body 202 as a designer might select.

The lace element 204 may be included as a functional member of the ball 200, for example to secure in part body segments 206, 212 to one another. Alternatively, the lace element 204 may be attached to perform a decorative function or may be included only to assist a user in correctly positioning his or her hand to pass or grip the ball 200. The lace element 204 may be attached to the body 202 in any suitable conventional manner, depending on the materials selected for the body 202 and the lace element 204. For example, the body 202 and the lace element 204 may both be made from leather and the lace element 204 may be inserted into perforations in the body 202. In such a case, it may be desirable to include reinforcements on the body 202 to prevent the lace element 204 from tearing through the body 202. In another example, the body 202 might be rubber and the lace element 204 might be polyvinyl chloride, rubber, silicone, or other thermoplastic elastomers. In such a case, an adhesive might be used to adhere the lace element 204 to the outside of the body 202.

The body 202 of the ball 200 includes a first end 214 and a second end 216. The body 202 also includes a longitudinal axis 218 and a transverse axis 220. The body 202 may have a single color, but may have various indicia imprinted thereon that may be of various colors. Even if indicia of varying colors are imprinted thereon, the body 202 is made from a material that has a first color.

At the first end 214 of the body 202 is a first tip 222. At the second end 216 of the body 202 is a second tip 224. Each of the first and second tips 222, 224 is colored with a second color that contrasts with the first color. The outer periphery 226 of the first tip 222 has a ring shape. The outer periphery 228 of the second tip 224 has a ring shape. Each ring shape is continuous around the circumference of the body 202 at its respective position along the body 202 or the longitudinal axis 218 of the body 202.

The body also includes a first mid region 229 between the first tip 222 and the transverse axis 220 and a second mid region 230 between the second tip 224 and the transverse axis 220. A portion 232 of the first mid region 229 is colored with the second color. A portion 234 of the second mid region 230 is colored with the second color. The portion 232 of the first mid region 229 that is colored with the second color includes an outer periphery 236 and an inner periphery 238. The outer periphery 236 has a ring shape and is continuous around the body 202. As is best seen in FIG. 5, the inner periphery 238 has a ring shape over at least half the circumference of the body 202. The portion 234 of the second mid region 230 that is colored with the second color has an outer periphery 240 and an inner periphery 242. The inner periphery 240 is ring shaped and is continuous around the body 202. The inner periphery 242 has a ring shape over at least half the circumference of the body 202.

It is desirable that the outer peripheries of the tips 226, 228 and the mid region portions colored with the second color 236, 240 be ring shaped and continuous around the body 202 in each periphery's longitudinal position along the longitudinal axis 218. When the peripheries 226, 228, 236, 240 are continuous, a receiver's eye is able to see the tip and mid portions easily without the flickering or blurring that is common when the tip and mid portions do not have a continuous boundary or periphery.

In this exemplary embodiment, the first inner periphery 238 includes a portion that extends to form a finger portion 244 adjacent the lace element 204. In this exemplary embodiment, the first inner periphery 238 includes a second portion that extends to form a second finger portion 246 adjacent and on the other side of the lace element 204. In this exemplary embodiment, the second inner periphery 242 includes a portion that extends to form a finger portion 248 adjacent the lace element 204. In this exemplary embodiment, the second inner periphery 242 includes a second portion that extends to form a second finger portion 250 adjacent and on the other side of the lace element 204. The use of finger portions 244, 246, 248, 250 may also be useful in assisting a receiver in catching a ball. The finger portions 244, 246, 248, 250 should be selected to be aesthetically pleasing, but to be sufficiently small that they do not create excessive flickering when a receiver views the ball 200 from one of its end 214, 216. However, the finger portions 244, 246, 248, 250 should be large enough that they will create a small amount of flickering to catch the attention of a receiver from his or her peripheral vision when the ball is in the air, particularly when viewing the ball 200 obliquely. The finger portions 244, 246, 248, 250 need not be placed adjacent the lace element 204. However, because the lace element 204 already provide a certain level of visual discontinuity when the ball 200 rotates, such a position may be desirable, given the considerations to be balanced.

The first color may be a generally tan color, but may be any color that a designer feels is appropriate for the particular application. The second color should contrast with the first color and may be any color that contrasts highly with the first color. In one exemplary embodiment, the second color has a dominant wavelength between about 520 nm and about 770 nm. Both the first color and the second color may be flat, as colors having sheen or gloss may be less able to be seen in certain lighting conditions. The second color may cover no more than about 50% of the surface area of the body 202.

Figure 7:
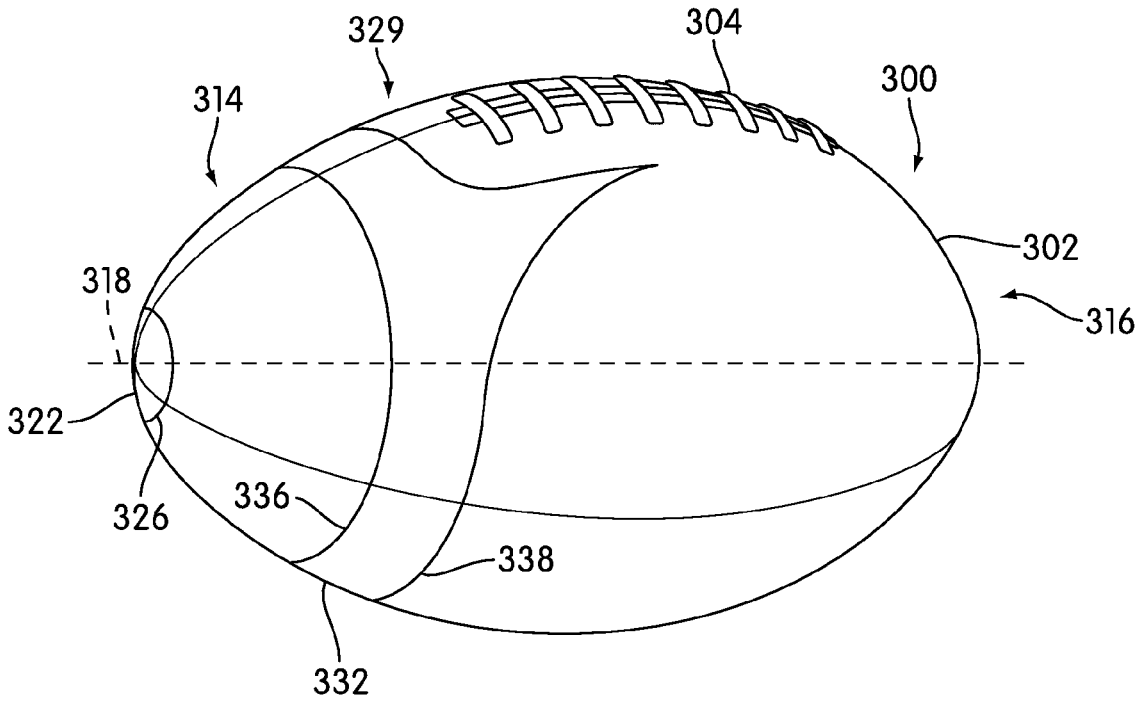
FIG. 7 is a perspective view of a third exemplary embodiment.
Figure 8:
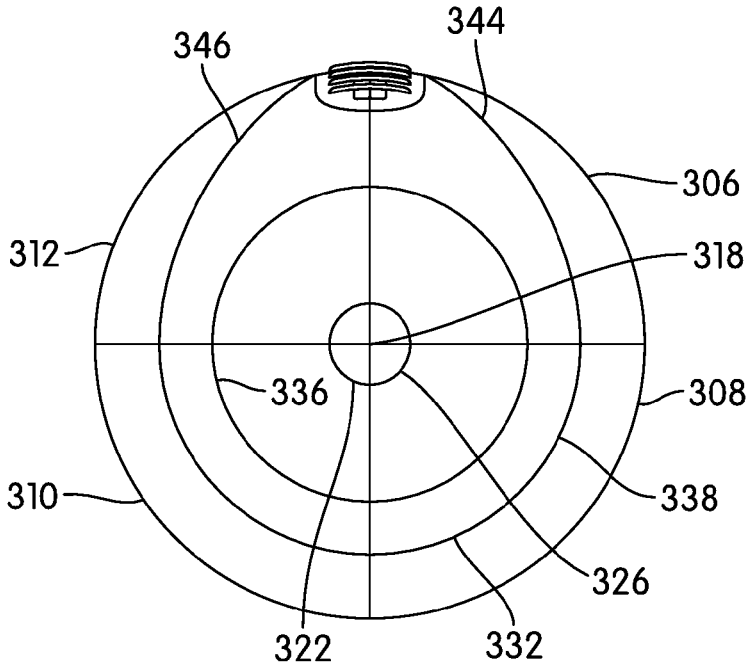
FIG. 8 is an end view of the third exemplary embodiment.
Figure 9:
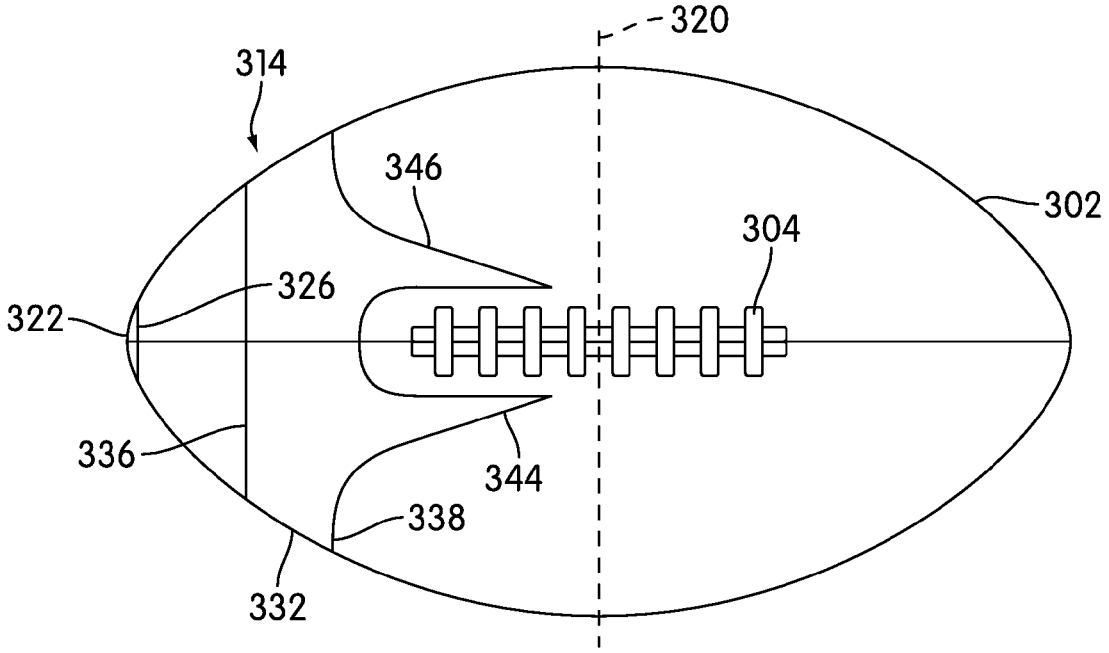
FIG. 9 is a top view of a third exemplary embodiment.

Another exemplary embodiment is shown in FIGS. 7-9. In this embodiment, FIGS. 7-9 show a prolate spheroidal ball 300. The ball 300 includes a body 302 and lace element 304. The body 302 may be made of one or more body segments 306, 308, 310, 312. As is shown in FIGS. 7-9, one embodiment of the body 302 may include four body segments 306, 308, 310, 312 that are sewn or otherwise secured together. A bladder (not shown) inside the body 302 is filled with air to a particular pressure level. A variety of pressure levels may be appropriate for any particular game. No specific structure is necessary to allow a user to fill the body 302 with air, but a conventional inflation valve (not shown) that permits the insertion of a typical needle (not shown) that may be connected to a bicycle pump or other suitable pump (not shown) may be included. Such an inflation valve may be positioned anywhere desirable on the body 302 as a designer might select.

The lace element 304 may be included as a functional member of the ball 300, for example to secure in part body segments 306, 312 to one another. Alternatively, the lace element 304 may be attached to perform a decorative function or may be included only to assist a user in correctly positioning his or her hand to pass or grip the ball 300. The lace element 304 may be attached to the body 302 in any suitable conventional manner, depending on the materials selected for the body 302 and the lace element 304. For example, the body 302 and the lace element 304 may both be made from leather and the lace element 304 may be inserted into perforations in the body 302. In such a case, it may be desirable to include reinforcements on the body 302 to prevent the lace element 304 from tearing through the body 302. In another example, the body 302 might be rubber and the lace element 304 might be polyvinyl chloride, rubber, silicone, or other thermoplastic elastomers. In such a case, an adhesive might be used to adhere the lace element 304 to the outside of the body 302.

The body 302 of the ball 300 includes a first end 314 and a second end 316. The body 302 also includes a longitudinal axis 318 and a transverse axis 320. The body 302 may have a single color, but may have various indicia imprinted thereon that may be of various colors. Even if indicia of varying colors are imprinted thereon, the body 302 is made from a material that has a first color.

At the first end 314 of the body 302 is a first tip 322. The first tip 322 is colored with a second color that contrasts with the first color. The outer periphery 326 of the first tip 322 has a ring shape. The ring shape is continuous around the circumference of the body 302 at its position along the body 302 or the longitudinal axis 318 of the body 302.

The body also includes a first mid region 329 between the first tip 322 and the transverse axis 320. A portion 332 of the first mid region 329 is colored with the second color. The portion 332 of the first mid region 329 that is colored with the second color includes an outer periphery 336 and an inner periphery 338. The outer periphery 336 has a ring shape and is continuous around the body 302. As is best seen in FIG. 8, the inner periphery 338 has a ring shape over at least half the circumference of the body 302.

It is desirable that the outer peripheries of the tip 326 and the mid region portion colored with the second color 336 be ring shaped and continuous around the body 302 in each periphery's longitudinal position along the longitudinal axis 318. When the peripheries 326, 336 are continuous, a receiver's eye is able to see the tip and mid portions easily without the flickering or blurring that is common when the tip and mid portions do not have a continuous boundary or periphery.

In this exemplary embodiment, the first inner periphery 338 includes a portion that extends to form a finger portion 344 adjacent the lace element 304. In this exemplary embodiment, the first inner periphery 338 includes a second portion that extends to form a second finger portion 346 adjacent and on the other side of the lace element 304. The use of finger portions 344, 346 may also be useful in assisting a receiver in catching a ball. The finger portions 344, 346 should be selected to be aesthetically pleasing, but to be sufficiently small that they do not create excessive flickering when a receiver views the ball 300 from its end 314. However, the finger portions 344, 346 should be large enough that they will create a small amount of flickering to catch the attention of a receiver from his or her peripheral vision when the ball is in the air, particularly when viewing the ball 300 obliquely. The finger portions 344, 346 need not be placed adjacent the lace element 304. However, because the lace element 304 already provide a certain level of visual discontinuity when the ball 300 rotates, such a position may be desirable, given the considerations to be balanced.

The first color may be a generally tan color, but may be any color that a designer feels is appropriate for the particular application. The second color should contrast with the first color and may be any color that contrasts highly with the first color. In one exemplary embodiment, the second color has a dominant wavelength between about 520 nm and about 770 nm. Both the first color and the second color may be flat, as colors having sheen or gloss may be less able to be seen in certain lighting conditions. The second color may cover no more than about 50% of the surface area of the body 302.

Figure 10:
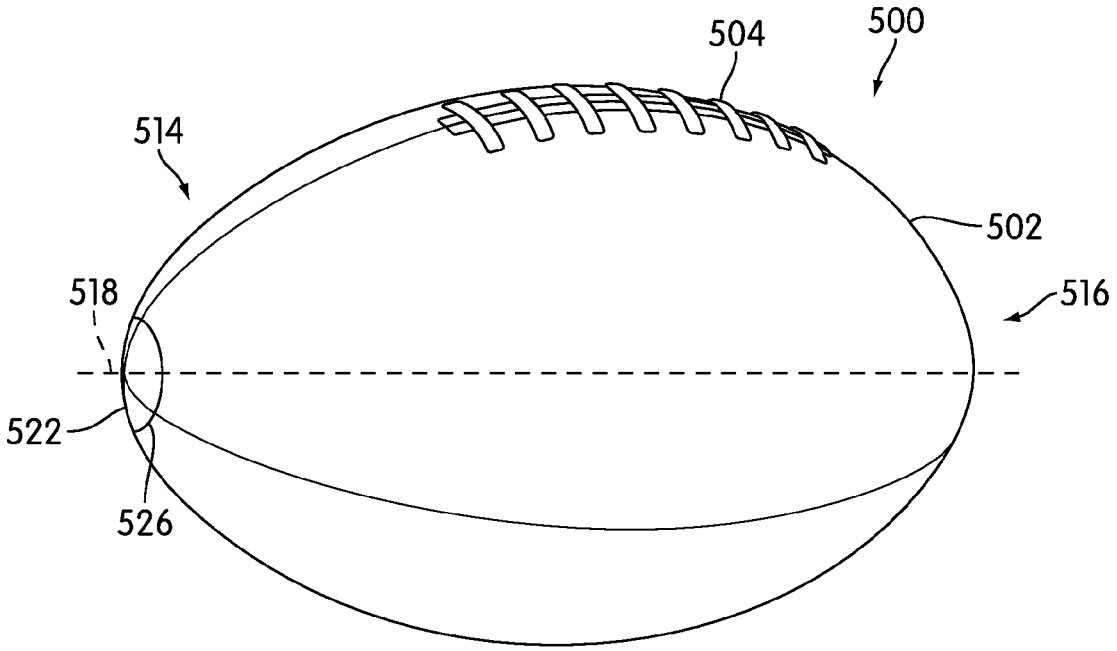
FIG. 10 is a perspective view of a fourth exemplary embodiment.
Figure 11:
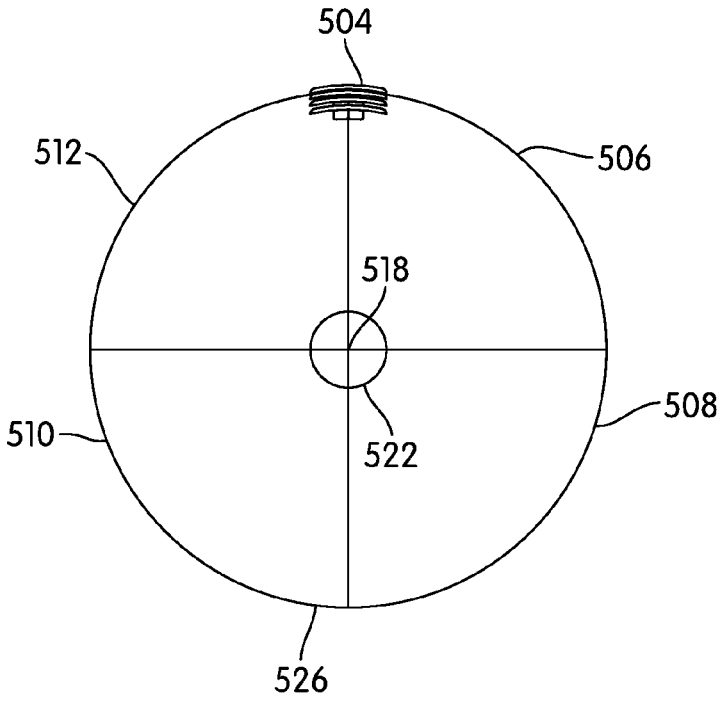
FIG. 11 is an end view of the fourth exemplary embodiment.
Figure 12:
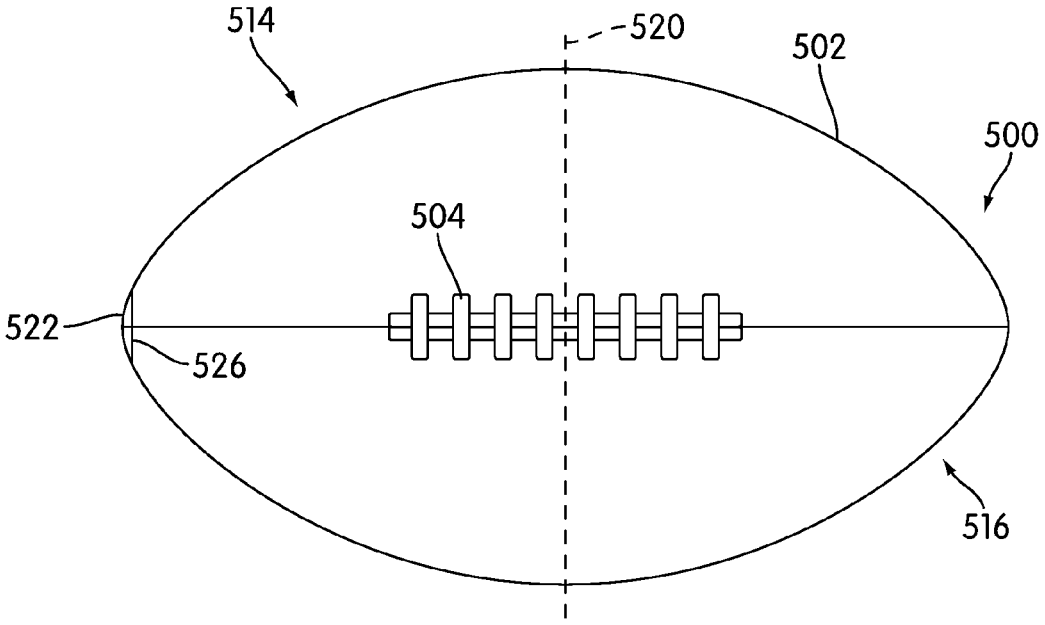
FIG. 12 is a top view of the fourth exemplary embodiment.

Another exemplary embodiment is shown in FIGS. 10-12. In this embodiment, FIGS. 10-12 show a prolate spheroidal ball 500. The ball 500 includes a body 502 and lace element 504. The body 502 may be made of one or more body segments 506, 508, 510, 512. As is shown in FIGS. 10-12, one embodiment of the body 502 may include four body segments 506, 508, 510, 512 that are sewn or otherwise secured together. A bladder (not shown) inside the body 502 is filled with air to a particular pressure level. A variety of pressure levels may be appropriate for any particular game. No specific structure is necessary to allow a user to fill the body 502 with air, but a conventional inflation valve (not shown) that permits the insertion of a typical needle (not shown) that may be connected to a bicycle pump or other suitable pump (not shown) may be included. Such an inflation valve may be positioned anywhere desirable on the body 502 as a designer might select.

The lace element 504 may be included as a functional member of the ball 500, for example to secure in part body segments 506, 512 to one another. Alternatively, the lace element 504 may be attached to perform a decorative function or may be included only to assist a user in correctly positioning his or her hand to pass or grip the ball 500. The lace element 504 may be attached to the body 502 in any suitable conventional manner, depending on the materials selected for the body 502 and the lace element 504. For example, the body 502 and the lace element 504 may both be made from leather and the lace element 504 may be inserted into perforations in the body 502. In such a case, it may be desirable to include reinforcements on the body 502 to prevent the lace element 504 from tearing through the body 502. In another example, the body 502 might be rubber and the lace element 504 might be polyvinyl chloride, rubber, silicone, or other thermoplastic elastomers. In such a case, an adhesive might be used to adhere the lace element 504 to the outside of the body 502.

The body 502 of the ball 500 includes a first end 514 and a second end 516. The body 502 also includes a longitudinal axis 518 and a transverse axis 520. The body 502 may have a single color, but may have various indicia imprinted thereon that may be of various colors. Even if indicia of varying colors are imprinted thereon, the body 502 is made from a material that has a first color.

At the first end 514 of the body 502 is a first tip 522. The first tip 522 is colored with a second color that contrasts with the first color. The outer periphery 526 of the first tip 522 has a ring shape. The ring shape is continuous around the circumference of the body 502 at its position along the body 502 or the longitudinal axis 518 of the body 502.

It is desirable that the outer periphery of the tip 526 be ring shaped and continuous around the body 502 at its longitudinal position along the longitudinal axis 518. When the periphery 526 is continuous, a receiver's eye is able to see the tip easily without the flickering or blurring that is common when the tip does not have a continuous boundary or periphery.

The first color may be a generally tan color, but may be any color that a designer feels is appropriate for the particular application. The second color should contrast with the first color and may be any color that contrasts highly with the first color. In one exemplary embodiment, the second color has a dominant wavelength between about 520 nm and about 770 nm. Both the first color and the second color may be flat, as colors having sheen or gloss may be less able to be seen in certain lighting conditions. The second color may cover no more than about 50% of the surface area of the body 502.

FIGS. 4-6 disclose a ball 200 that includes first and second ends 214, 216 and first and second mid regions 229, 230. Each of the ends and mid regions includes a portion 222, 224, 232, 234 that is colored with a second color. FIGS. 7-9 disclose a ball 300 that includes first end 314 and first mid region 329. First end 314 and first mid region 329 each include a portion that is colored with a second color. FIGS. 10-12 disclose a ball 500 that includes first end 514. First end 514 includes a portion that is colored with a second color. A person having ordinary skill in the art will understand that it is possible to modify the present embodiments to include different colorations in accordance with a user's preference. For example, a design could be created that included coloring only the first and second ends with the second color. Alternatively, a design could be created that included coloring only the first and second mid portions with the second color. As another alternative, a design could be created that colored the first end and the second mid portion with the second color. Any of these designs could be useful in a particular situation.

Figure 13:
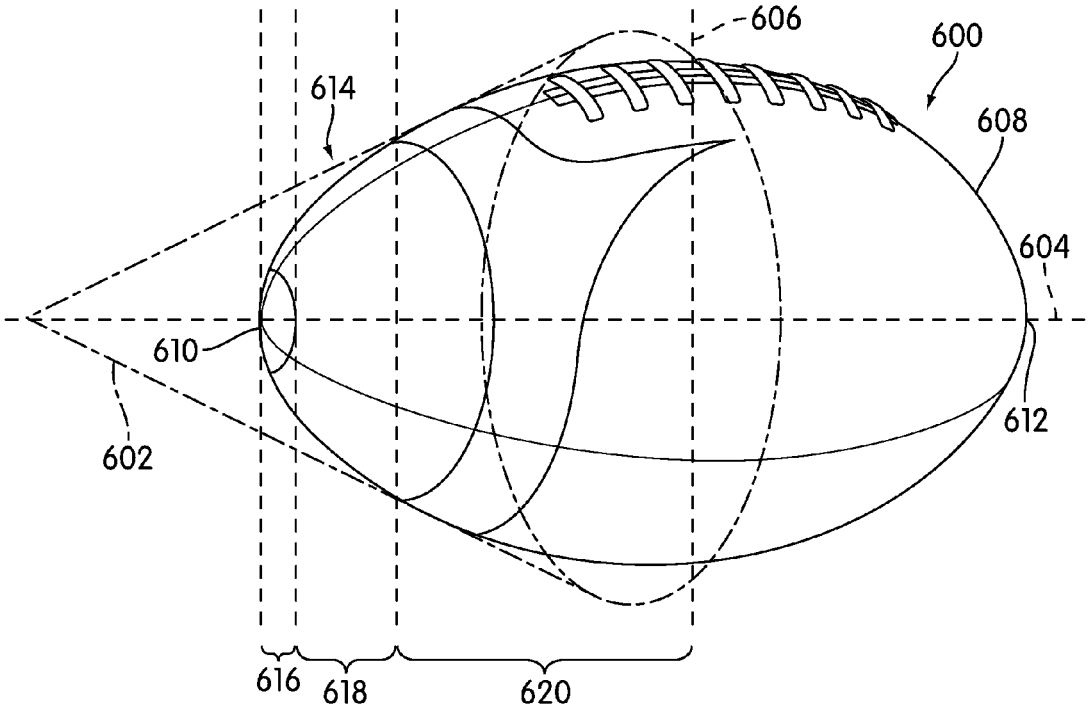
FIG. 13 is a perspective view of the second exemplary embodiment with a cone superimposed over a portion of the body.

Turning now to FIG. 13, another exemplary embodiment is shown. The ball 600 is shown with a cone 602 thereover. Each half of the prolate spheroid ball 600 could be approximated as a cone 602. The ball 600 has a longitudinal axis 604 and a transverse axis 606. The ball 600 has an external surface 608. The ball 600 also has a first longitudinal end 610 and a second longitudinal end 612. The longitudinal ends 610, 612 are positioned on the external surface 608 in the positions where the longitudinal axis 604 intersects the external surface 608.

The ball 600 has a first body portion 614 that extends from its first longitudinal end 610 to its transverse axis 606. The first body portion 614 is approximately conical in shape. The first body portion 614 is divided into three sections 616, 618, 620.

The first section 616 extends from the first longitudinal end and is conical in shape. The third section 620 extends from the transverse axis and is generally frustoconical in shape. The second section 618 is positioned between the first section 616 and the third section 620 and is generally frustoconical in shape.

The first section 616 and the second section 618 are colored with contrasting colors. The second section 618 and at least one area of the third section 620 are colored with contrasting colors.

Figure 14:
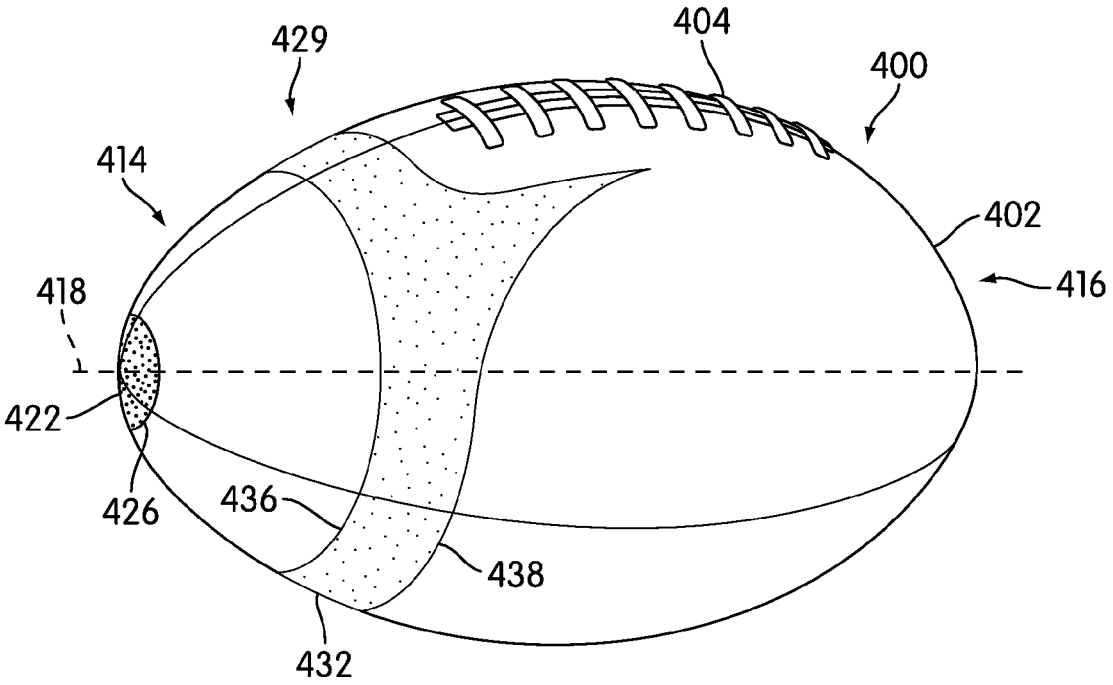
FIG. 14 is a perspective view of a fifth exemplary embodiment.
Figure 15:
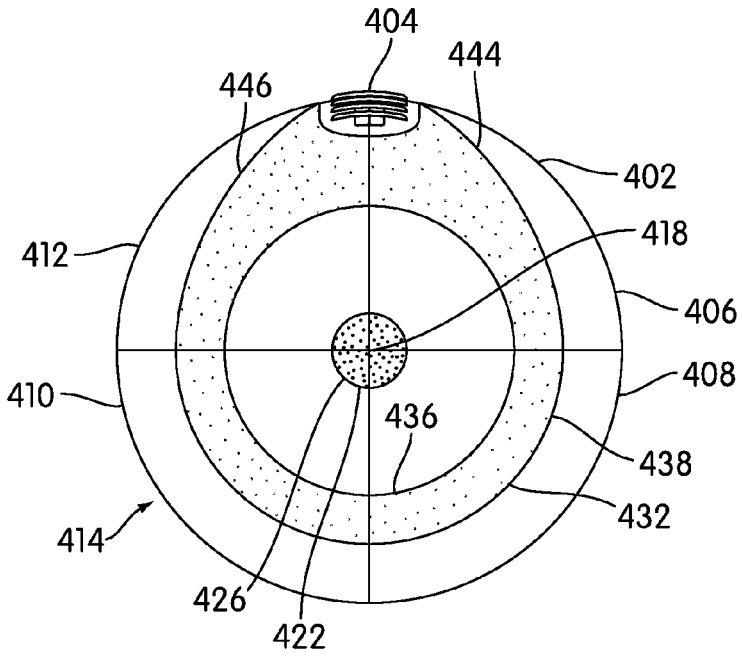
FIG. 15 is an end view of the fifth exemplary embodiment.
Figure 16:
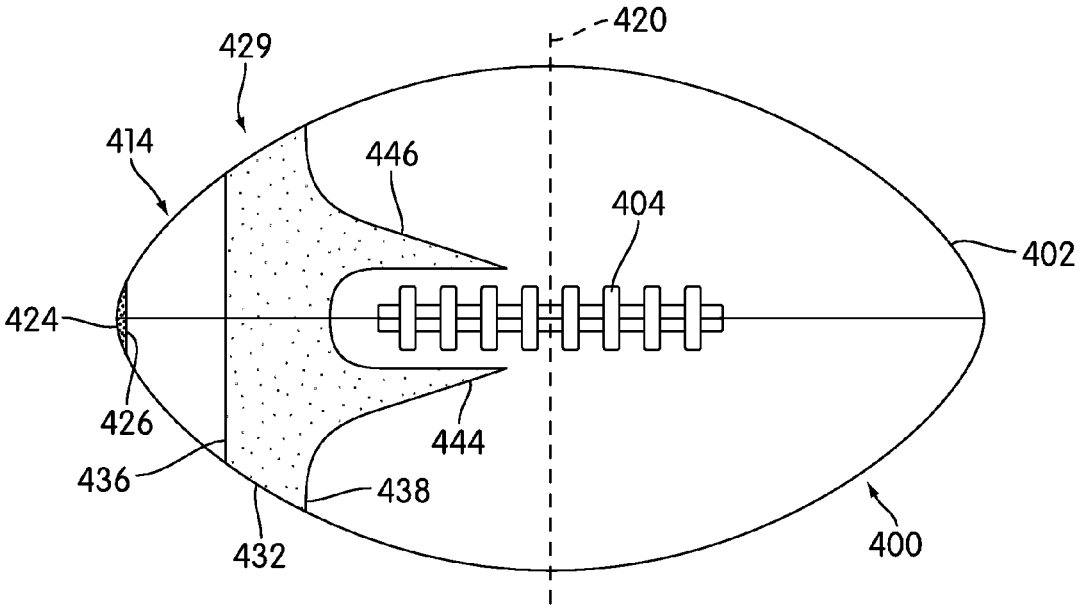
FIG. 16 is a top view of the fifth exemplary embodiment.

Another exemplary embodiment is shown in FIGS. 14-16. In this embodiment, FIGS. 14-16 show a prolate spheroidal ball 400. The ball 400 includes a body 402 and lace element 404. The body 402 may be made of one or more body segments 406, 408, 410, 412. As is shown in FIGS. 14-16, one embodiment of the body 402 may include four body segments 406, 408, 410, 412 that are sewn or otherwise secured together. A bladder (not shown) inside the body 402 is filled with air to a particular pressure level. A variety of pressure levels may be appropriate for any particular game. No specific structure is necessary to allow a user to fill the body 402 with air, but a conventional inflation valve (not shown) that permits the insertion of a typical needle (not shown) that may be connected to a bicycle pump or other suitable pump (not shown) may be included. Such an inflation valve may be positioned anywhere desirable on the body 402 as a designer might select.

The lace element 404 may be included as a functional member of the ball 400, for example to secure in part body segments 406, 412 to one another. Alternatively, the lace element 404 may be attached to perform a decorative function or may be included only to assist a user in correctly positioning his or her hand to pass or grip the ball 400. The lace element 404 may be attached to the body 402 in any suitable conventional manner, depending on the materials selected for the body 402 and the lace element 404. For example, the body 402 and the lace element 404 may both be made from leather and the lace element 404 may be inserted into perforations in the body 402. In such a case, it may be desirable to include reinforcements on the body 402 to prevent the lace element 404 from tearing through the body 402. In another example, the body 402 might be rubber and the lace element 404 might be polyvinyl chloride, rubber, silicone, or other thermoplastic elastomers. In such a case, an adhesive might be used to adhere the lace element 404 to the outside of the body 402.

The body 402 of the ball 400 includes a first end 414 and a second end 416. The body 402 also includes a longitudinal axis 418 and a transverse axis 420. The body 402 may have a single color, but may have various indicia imprinted thereon that may be of various colors. Even if indicia of varying colors are imprinted thereon, the body 402 is made from a material that has a first color.

At the first end 414 of the body 402 is a first tip 422. The first tip 422 is colored with a second color that contrasts with the first color. The outer periphery 426 of the first tip 422 has a ring shape. The ring shape is continuous around the circumference of the body 402 at its position along the body 402 or the longitudinal axis 418 of the body 402.

The body also includes a first mid region 429 between the first tip 422 and the transverse axis 420. A portion 432 of the first mid region 429 is colored with a third color that contrasts with the first color. The portion 432 of the first mid region 429 that is colored with the third color includes an outer periphery 436 and an inner periphery 438. The outer periphery 436 has a ring shape and is continuous around the body 402. As is best seen in FIG. 15, the inner periphery 438 has a ring shape over at least half the circumference of the body 402.

It is desirable that the outer peripheries of the tip 426 and the mid region portion colored with the third color 436 be ring shaped and continuous around the body 402 in each periphery's longitudinal position along the longitudinal axis 418. When the peripheries 426, 436 are continuous, a receiver's eye is able to see the tip and mid portions easily without the flickering or blurring that is common when the tip and mid portions do not have a continuous boundary or periphery.

In this exemplary embodiment, the first inner periphery 438 includes a portion that extends to form a finger portion 444 adjacent the lace element 404. In this exemplary embodiment, the first inner periphery 438 includes a second portion that extends to form a second finger portion 446 adjacent and on the other side of the lace element 404. The use of finger portions 444, 446 may also be useful in assisting a receiver in catching a ball. The finger portions 444, 446 should be selected to be aesthetically pleasing, but to be sufficiently small that they do not create excessive flickering when a receiver views the ball 400 from its end 414. However, the finger portions 444, 446 should be large enough that they will create a small amount of flickering to catch the attention of a receiver from his or her peripheral vision when the ball is in the air, particularly when viewing the ball 400 obliquely. The finger portions 444, 446 need not be placed adjacent the lace element 404. However, because the lace element 404 already provide a certain level of visual discontinuity when the ball 400 rotates, such a position may be desirable, given the considerations to be balanced.

The first color may be a generally tan color, but may be any color that a designer feels is appropriate for the particular application. The second and colors should contrast with the first color and may be any color that contrasts highly with the first color. In one exemplary embodiment, the second and third colors have dominant wavelengths between about 520 nm and about 770 nm. The first, second, and third colors may be flat, as colors having sheen or gloss may be less able to be seen in certain lighting conditions. The second and third colors may cover no more than about 50% of the surface area of the body 402.

The embodiments discussed all include regions having a standard football color and a second color that contrasts with the color of a standard football. The preferred color is a color having a dominant wavelength between about 520 nm and about 770 nm, placing it in the yellow to green range. The use of a ball having two colors in and of itself enhances its visibility. In order to enhance visibility, it is desirable that the two contrasting colors be selected so that one is significantly lighter than the other. In addition, the colors must be selected to maintain a high degree of visibility against the background of the sky and field on which the game is played. In addition, the use of complementary colors is desirable.

Instead, the use of a color in the 520-770 range as the second and third color with the traditional football color is desirable. The human eye is particularly sensitive to colors in this wavelength, so the use of such colors enhances visibility. In addition, the use of colors of that wavelength is considered pleasing to the eye when placed next to a traditional football color. Finally, the use of colors of that wavelength will also create contrast against the sky and vield. Accordingly, the use of such wavelengths as a second color on a football is desirable.

The use of an area with a solid line and another area with an irregular color pattern of some sort on the ball may also be desirable. In playing football and other sports, peripheral vision is very important and an athlete's level of success at a sport is often linked to his or her ability to perceive things peripherally at a high level. A human's central vision is best at detecting detail and takes up about three percent of the visual field. Objects which are still or which have a constant contour are best perceived in this area. In the remaining area, a degree of flicker is useful to detect motion. A discontinuity in pattern or color on a basketball produces a flicker, which enables a user to more quickly detect the ball. This will tend to allow the user to recognize the ball, compute its trajectory, and determine a course of action more quickly than if the ball is a single color or pattern. In addition, the flicker particularly enhances performance in low light conditions.

It may also be particularly desirable to include the markings noted in the various embodiments on one end only of a football. In football, a quarterback or coach will sometimes call a play known as a "play action pass." In such a case, the quarterback will "fake" or pretend to hand the football to a runner, such as a fullback, in order to fool the defensive players into leaving their coverage of the receivers and pursuing the fullback. The quarterback can then pass the football to a receiver without interference from a defense player. When such a play is called, it is desirable to conceal the ball from the defense. If the markings described herein are present only on one end of a football, it will be easier for a quarterback to hide or conceal the ball before the pass is thrown.

Further, it may be desirable to use different markings on different ends of a ball. For example, in certain circumstances, a player may not need to see the ball from an oblique angle in his peripheral vision before moving his head to place the ball in the center of his visual field. In such instances, as, for example with a flea flicker pass, the flicker caused by the fingers could be detrimental. In other circumstances, the receiver may only be able to see the ball from peripheral vision for most of the path of the ball, and only turn to place the ball in the center of vision just before receiving the ball, such as when a post pattern is run. It is notable that in such situations where the ball is in a receiver's peripheral vision for most of the flight of the ball, the continuous ring can be even more critical than in other circumstances, as the receiver may only have a very brief moment in which the ball is in his central vision. Accordingly, it could be desirable to include fingers with other markings on one end of the ball and, for example, only a dot on the other end to accommodate these different passing situations.

Various embodiments in this disclosure are described as including segments or portions that have peripheries that are described as being ring-shaped or continuous or both. The segments may be described as being conical or frustoconical in shape. It is to be understood by a person having ordinary skill in the art that the shape and coloring of the ball may be limited by tolerances in painting equipment, material imperfections, indentations between body segments and the like. Accordingly, while items have been described as ring-shaped and continuous around the body, small variations in the shape of the peripheries and colorations are permitted and still fall within the definitions of ring-shaped and continuous without departing from the definitions of those terms. In addition, while the segments or portions may be described as being conical or frustoconical, departure from the shape of a true cone or frustocone from a geometrical perspective, such as through curved outer surfaces, is permitted and still falls within the definitions of these terms.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A prolate spheroidal ball, including a body having a first end, a second end, a longitudinal axis, a transverse axis, and made of material having a first color;

the body including a first tip located at the first end, the first tip being colored with a second color that contrasts with the first color, an outer periphery of the tip having a ring shape continuous around the body; and the body further including a first mid region between the first tip and the transverse axis, a portion of the first mid region being colored with the second color, an outer periphery of the mid region portion colored with the second color having a ring shape continuous around the body and an inner periphery of the mid region portion colored with the second color having a ring shape continuous around at least half a circumference of the body;

wherein the ring shape of the first tip, the ring shape of the outer periphery, and the ring shape of the inner periphery are concentric; and wherein a portion of the inner periphery of the first mid region portion colored with the second color extends substantially longitudinally to form a first finger portion adjacent a longitudinally oriented lace element, wherein the first finger portion extends substantially parallel to the lace element but is disposed in non-alignment with the lace element.

2. The prolate spheroidal ball of claim 1, wherein the first color is a generally tan color and the second color contrasts highly with the first color.

3. The prolate spheroidal ball of claim 1, wherein the second color has a dominant wavelength between about 520 and about 770 nm.

4. The prolate spheroidal ball of claim 2, wherein the first color and the second color are flat.

5. The prolate spheroidal ball of claim 2, wherein the three ring shaped peripheries form a series of concentric rings.

6. The prolate spheroidal ball of claim 1, wherein a portion of the inner periphery of the first mid region portion colored with the second color extends longitudinally to form a second finger portion adjacent the lace element, wherein the second finger portion is disposed on an opposite side of the lace element from the first finger portion, and wherein the second finger portion extends substantially parallel to the lace element and the first finger portion.

7. A prolate spheroidal ball, including:

a body having a first end, a second end, a longitudinal axis, a transverse axis, and made of material having a first color;

the body including a first tip located at the first end, the first tip being colored with a second color that contrasts with the first color, an outer periphery of the tip having a ring shape; and the body includes a mid region having an inner periphery and an outer periphery relative to a transverse axis of the body;

wherein the peripheries are arranged concentrically to form a series of concentric rings; and wherein a portion of the inner periphery of the mid region is colored with the second color and extends substantially longitudinally to form a first finger portion adjacent a longitudinally oriented lace element, wherein the first finger portion extends substantially parallel to the lace element but is disposed in non-alignment with the lace element.

8. The prolate spheroidal ball of claim 7, wherein the first color is a generally tan color and the second color contrasts highly with the first color.

9. The prolate spheroidal ball of claim 7, wherein the second color has a dominant wavelength between about 520 and about 770 nm.

10. The prolate spheroidal ball of claim 7, wherein the first color and the second color are flat.

11. The prolate spheroidal ball of claim 7, wherein the second color covers no more than about 50% of a surface area of the body.

12. A prolate spheroidal ball, comprising:

a body having a longitudinal axis, a transverse axis, an external surface, and first and second ends;

wherein a first body portion extends from the transverse axis to the first end, the first body portion being conical in shape;

wherein the first body portion is divided into three sections, a first section extending from the first end and being conical in shape and terminating in a ring, a third section being frustoconical in shape and extending from the transverse axis to terminate in a ring, and a second section being frustoconical in shape and extending between the first section and the third section;

wherein the first section and the second section have contrasting colors, the second section and at least a first area of the third section are contrasting colors along their boundaries;

wherein the second section and at least a second area of the third section are substantially the same color and the at least a second area is separated from the second section by the at least a first area; and wherein the first area of the third section extends substantially longitudinally to form a first finger portion adjacent a longitudinally oriented lace element, wherein the first finger portion extends substantially parallel to the lace element but is disposed in non-alignment with the lace element.

13. A prolate spheroidal ball, including:

a body having a first end, a second end, a longitudinal axis, a transverse axis, and made of material having a first color;

the body including a first tip located at the first end;

the body further including a first mid region between the first tip and the transverse axis, a portion of the first mid region being colored with a second color, an outer periphery of the first mid region portion colored with the second color having a ring shape continuous around the body;

wherein an inner periphery of the first mid region portion colored with the second color includes an inner periphery that is ring shaped over at least half of a circumference of the body; and wherein a portion of the inner periphery of the first mid region portion colored with the second color extends substantially longitudinally to form a first finger portion adjacent a longitudinally oriented lace element, wherein the first finger portion extends substantially parallel to the lace element but is disposed in non-alignment with the lace element.

14. The prolate spheroidal ball of claim 13, wherein the first finger portion includes a first free end.

15. The prolate spheroidal ball of claim 14, wherein the first free end is spaced from the transverse axis of the ball and wherein the first free end is on the same side of the transverse axis as the first mid region.

16. The prolate spheroidal ball of claim 13, further comprising a second tip located at a second end;

the body further including a second mid region between the second tip and the transverse axis, a portion of the second mid region being colored with the second color, an outer periphery of the second mid region portion colored with the second color having a ring shape continuous around the body;

wherein an inner periphery of the second mid region portion colored with the second color includes an inner periphery that is ring shaped over at least half of the circumference of the body; and wherein a portion of the inner periphery of the first mid region portion colored with the second color extends longitudinally to form a second finger portion adjacent the lace element, wherein the second finger portion is disposed on an opposite side of the lace element from the first finger portion, and wherein the second finger portion extends substantially parallel to the lace element and the first finger portion.

17. The prolate spheroidal ball of claim 16, wherein the second finger portion includes a second free end spaced from the transverse axis of the ball, wherein the second free end is on the same side of the transverse axis as the second mid region and the first free end is adjacent to and spaced from the second free end.

18. A prolate spheroidal ball, including:

a body having a first end, a second end, a longitudinal axis, a transverse axis, and made of material having a first color;

the body including a first tip located at the first end, the first tip being colored with a second color that contrasts with the first color, an outer periphery of the tip having a ring shape; and the body further including a first mid region between the first tip and the transverse axis, a portion of the first mid region being colored with a third color different from the first color and the second color and that contrasts with the first color, an outer periphery of the first mid region portion colored with the third color having a ring shape continuous around the body;

wherein a first section of the first mid region portion that is colored with the third color extends substantially longitudinally to form a first finger portion adjacent a longitudinally oriented lace element, wherein the first finger portion extends substantially parallel to the lace element but is disposed in non-alignment with the lace element.

19. The prolate spheroidal ball of claim 18, wherein the first color is a generally tan color and the second and third colors are colors that contrast highly with the first color.

20. The prolate spheroidal ball of claim 18, wherein the second and third colors have dominant wavelengths between about 520 and about 770 nm.

21. The prolate spheroidal ball of claim 18, wherein the first, second, and third colors are flat.

22. The prolate spheroidal ball of claim 18, wherein a second section of the first mid region portion that is colored with the third color extends substantially longitudinally to form a second finger portion, wherein the second finger portion is disposed on an opposite side of the lace element from the first finger portion, and wherein the second finger portion extends substantially parallel to the lace element and the first finger portion.

23. The prolate spheroidal ball of claim 18 , wherein an inner periphery of the mid region portion colored with the third color includes an inner periphery that is ring shaped over at least half of a circumference of the body.

24. The prolate spheroidal ball of claim 1, the body including a second tip located at the second end; and the body further including a second mid region between the second tip and the transverse axis, a portion of second mid region being colored with the second color, an outer periphery of the portion of the mid region that is colored with the second color having a ring shape continuous around the body and an inner periphery having a ring shape continuous around at least half a circumference of the body; and wherein a portion of the inner periphery of the portion of the second mid region that is colored with the second color extends substantially longitudinally to form a second finger portion adjacent the lace element, wherein the second finger portion extends substantially parallel to the lace element but is disposed in non-alignment with the lace element.

* * * * *